US011486051B2

(12) United States Patent
Hutchins et al.

(10) Patent No.: US 11,486,051 B2
(45) Date of Patent: Nov. 1, 2022

(54) DURABLE WHITE INORGANIC FINISH FOR ALUMINIUM ARTICLES

(71) Applicant: Keronite International Limited, Haverhill (GB)

(72) Inventors: Stephen Hutchins, Haverhill (GB); Suman Shrestha, Haverhill (GB)

(73) Assignee: Keronite International Limited, Haverhill (GB)

( * ) Notice: Subject to any disclaimer, the term of this patent is extended or adjusted under 35 U.S.C. 154(b) by 0 days.

(21) Appl. No.: 16/310,620

(22) PCT Filed: Jun. 16, 2017

(86) PCT No.: PCT/GB2017/051765
§ 371 (c)(1),
(2) Date: Dec. 17, 2018

(87) PCT Pub. No.: WO2017/216577
PCT Pub. Date: Dec. 21, 2017

(65) Prior Publication Data

US 2019/0177868 A1 Jun. 13, 2019

(30) Foreign Application Priority Data

Jun. 17, 2016 (GB) ..... 1610615
Jun. 22, 2016 (GB) ..... 1610942

(51) Int. Cl.
*C25D 11/02* (2006.01)
*C25D 11/14* (2006.01)
*C25D 11/10* (2006.01)

(52) U.S. Cl.
CPC ..... *C25D 11/10* (2013.01); *C25D 11/026* (2013.01); *C25D 11/14* (2013.01)

(58) Field of Classification Search
None
See application file for complete search history.

(56) References Cited

FOREIGN PATENT DOCUMENTS

| | | | | |
|---|---|---|---|---|
| DE | 4037392 A1 * | 5/1992 | ..... | C25D 11/026 |
| EP | 0823496 A1 | 2/1998 | | |
| EP | 1657326 A1 | 5/2006 | | |
| GB | 2516258 A * | 1/2015 | ..... | C25D 11/024 |
| GB | 2516258 A | 1/2015 | | |
| SU | 1537240 A1 * | 1/1990 | | |

OTHER PUBLICATIONS

Aluminum Alloy 7075 Data Sheet; United Aluminum ; https://www.unitedaluminum.com/united-aluminum-alloy-7075/; May 19, 2020 (Year: 2020).*

(Continued)

*Primary Examiner* — Humera N. Sheikh
*Assistant Examiner* — Elizabeth D Ivey
(74) *Attorney, Agent, or Firm* — Shumaker & Seiffert, P.A.

(57) ABSTRACT

There is disclosed a method of forming a high luminosity inorganic coating on an aluminium or aluminium alloy article, wherein the article is immersed in an electrolyte and subjected to a plasma anodising process, wherein the coating has a luminosity L*≥80.0% and comprises at least 50 wt % gamma alumina. Also disclosed are inorganic coatings formed by the method, and aluminium or aluminium alloys coated by the method.

9 Claims, 1 Drawing Sheet

X-ray diffraction pattern of the coating in Example 1

(56) References Cited

OTHER PUBLICATIONS

Porosity in plasma electrolytic oxide coatings; J.A. Curran, T.W. Clyne; Acta Materialia 54 (2006) 1985-1993; Available online Feb. 28, 2006 (Year: 2006).*
Nature of the growth of plasma electrolyte oxidation coating on Aluminum ; Lujun Zhu.etal; Institute of Microstructure and Property of Advanced Materials, Beijing University of Technology, Beijing 100124, China (Dec. 7, 2017) (Year: 2017).*
Bib Data and Translation—DE-4037392-A1—Coriand Frank et al; Coriand Frank; 1992 (Year: 1992).*
Bib Data and Translation—(SU 1537240 A1)—Peters et al; Jan. 23, 1990 (Year: 1990).*
By "Breakdown Strength"; Center for Chemical Process Safety; https://www.aiche.org/ccps/resources/glossary/process-safety-glossary/breakdown-strength; Nov. 19, 2022 (Year: 2022).*
International Search Report and Written Opinion for corresponding PCT Application No. PCT/GB2017/051765, dated Sep. 13, 2017, 13 pp.
Veys-Renaux et al., "Initial stages of multi-phased aluminium alloys anodizing by MAO: micro-arc conditions and electrochemical behaviour," Journal of solid State Electrochemistry, vol. 19, No. 10, Jul. 2, 2015, pp. 3121-3129, XP035551982.
Yerokhin et al., "Plasma electrolysis for surface engineering," Surface and Coatings Technology, vol. 122, Jan. 1, 1999, pp. 73-93, XP002992080.
Communication pursuant to Article 94(3) EPC from counterpart European Application No. 16/310,620 dated Oct. 28, 2021, 4 pp.

* cited by examiner

X-ray diffraction pattern of the coating in Example 1

Elemental composition of contaminants in the finish of Example 1

DURABLE WHITE INORGANIC FINISH FOR ALUMINIUM ARTICLES

This application is a national stage application under 35 U.S.C. § 371 of PCT Application No. PCT/GB2017/051765, filed Jun. 16, 2017, which claims the benefit of Great Britain Application No. 1610615.5, filed Jun. 17, 2016 and Great Britain Application No. 1610942.3, filed Jun. 22, 2016. The entire contents of each of PCT Application No. PCT/GB2017/051765, Great Britain Application No. 1610615.5, and Great Britain Application No. 1610942.3 are incorporated herein by reference in their entirety.

The present disclosure relates to a plasma anodising or plasma electrolytic oxidation (PEO) process for forming an alumina coating on aluminium articles, the coating having high luminosity and comprising a majority of gamma phase alumina. The disclosure also relates to coatings formed by such a process, and to articles provided with such coatings.

BACKGROUND

The plasma anodising process is a development of more conventional anodising technology, where different electrolytes are used and higher potentials and current densities (typically 10 to 200 $mAcm^{-2}$ as compared to 1-2 $mA \cdot cm^{-2}$ for more conventional anodising) are applied in order to achieve microscopic plasma discharges which modify the growing oxide film. It is sometimes also referred to as micro arc oxidation, spark anodizing, discharge anodizing, plasma electrolytic oxidation and other combinations of these terms. The technology has been developed for the surface protection of a wide range of metals, known as "valve" metals. These are metals which exhibit electrical rectifying behaviour in the electrolytic cell: under a given applied current, they will sustain a higher potential when anodically charged than when cathodically charged. Such metals include, for example, aluminium, magnesium, titanium, zirconium, hafnium, chromium, cobalt, molybdenum, vanadium and tantalum, and alloys of these metals.

Various existing processes for spark anodising are disclosed in U.S. Pat. No. 3,293,158 (Anodic spark reaction processes and articles—McNeill et al.), U.S. Pat. No. 5,792,335 (Anodization of magnesium and magnesium based alloys—Barton et al.), U.S. Pat. No. 6,365,028 (Method for producing hard protection coatings on articles made of aluminum alloys—Shatrov) and U.S. Pat. No. 6,896,785 (Process and device for forming ceramic coatings on metals and alloys, and coatings produced by this process—Shatrov et al.).

There are many patented and commercial variants of this process, the main distinguishing features of each variant being the applied electrical regime and electrolyte. Electrical regimes include direct current, pulsed direct current and a wide range of pulsed or alternating current regimes. Electrolyte systems are also very varied but the most commercially successful systems are aqueous, alkaline solutions. Several viable processes are described in the "Prior Art" section of U.S. Pat. No. 6,365,028. For example, U.S. Pat. No. 5,616,229 specifies a modified sine wave form at industrial (50-60 Hz) frequency from a source of at least 700V, and electrolytes consisting of KOH (at 0.5 $g/dm^3$) with up to 11 $g/dm^3$ of sodium tetrasilicate. This is one of the simpler electrolyte systems and is not particularly stable. U.S. Pat. No. 6,365,028 employs a more stable electrolyte consisting of an aqueous solution of an alkaline metal hydroxide at 1-5 $g/dm^3$, an alkali metal silicate at 2-15 $g/dm^3$, an alkaline metal pyrophosphate at 2-20 $g/dm^3$ and peroxide compounds at 2-7 $g/dm^3$.

The benefits of plasma anodising include both mechanical protection and corrosion protection. The mechanical protection is due to the formation of a hard, well-adhered layer of ceramic. The oxide layers tend to be significantly harder than more conventional hard anodised layers because the plasma discharge processes convert amorphous oxides into harder crystalline forms such as the alpha phase of alumina.

However, such crystallization is a purification process that tends to drive impurities into grain boundaries in the form of other oxides and compounds. In particular, transition metals added deliberately to the substrate alloy to influence its physical properties tend to form coloured oxides that prevent a white colour being achieved, except for very thin layers, as disclosed in DE4037393 or U.S. Pat. No. 4,869,789 for example. As the layer thickness grows, heat dissipation from the coating becomes slower and alpha crystallites in the molten layer have time to form before the layer solidifies. Thus, at higher thickness, typically >10 μm, these finishes have a tendency to discolour. At 10 μm or below, the layers typically display little durability or load-bearing capacity.

U.S. Pat. No. 4,869,789 describes a number of methods to achieve coloured coatings on light alloys including aluminium. Examples of white or ivory finishes are disclosed in this patent but the maximum thickness described is 10 μm.

One approach is to use alloys that have a zero or small content of transition metals. This avoids a concentration of transition metal oxides (and hence non-white colours) in the finish. Such alloys typically have low strength that limits their application. For example, DE4037393 discloses a method for creating a white coating on aluminium using a plasma anodizing process and an electrolyte consisting ammonium hydrogen phosphate and ammonium acetate but, significantly, describes results only for $AlMg_3$, which is an alloy that avoids significant quantities of transition metals and at a coating thickness of around 6 μm, which offers very little in the way of scratch or wear resistance.

In order to whiten the coating, it is possible to add certain elements to the electrolyte whose oxides may have naturally high luminosity (L*). For example, silicon, magnesium and tin salts are sometimes used for this purpose. The objective here is to incorporate the electrolyte elements by electrophoresis followed by oxidation under plasma conditions. The elements may be included as anions or cations in this case. The disadvantage of this method is that the resulting coatings are not especially white with L* values in the range 70-79%. Furthermore they tend to have a coarse microstructure and low crystallinity. This reduces the hardness of the coating and make it less wear resistant. An alternative approach is to add a suspension or sol of nanoparticles into the electrolyte to try and incorporate these into the coating. For example, silica sol or sodium silicate solution is often added for this effect. Such coatings commonly suffer from similar problems.

It is known, for example from GB2516258, to produce a ceramic oxide coating on aluminium 7075 alloy by way of a PEO process. 7075 alloy has a relatively high zinc content, zinc being a transition metal. The coating thus formed has a grey/black colour, and it is believed that this originates from copper in the alloy forming dark copper compounds (e.g. oxides) in the coating. Even though zinc oxide itself is typically white, even a small trace of coloured metal oxide (for example $CuO_2$, $Fe_2O_3$, FeO etc) can prevent the formation of a thick coating with good overall whiteness.

BRIEF SUMMARY OF THE DISCLOSURE

Viewed from a first aspect, there is provided a method of forming a high luminosity inorganic coating on an aluminium or aluminium alloy article, wherein the article is immersed in an electrolyte and subjected to a plasma anodising process, wherein the coating has a luminosity L*≥80% and comprises at least 50 wt % gamma-phase alumina.

Viewed from a second aspect, there is provided a high luminosity inorganic coating for an aluminium or aluminium alloy article, the inorganic coating being formed by way of a plasma anodising process, and wherein the coating has a luminosity L*≥80% and comprises at least 50 wt % gamma-phase alumina.

Viewed from a third aspect, there is provided an aluminium or aluminium alloy article coated with a high luminosity inorganic coating, the inorganic coating being formed by way of a plasma anodising process, and wherein the coating has a luminosity L*≥80% and comprises at least 50 wt % gamma-phase alumina.

Viewed from a fourth aspect, there is provided a method of forming a high luminosity inorganic coating on an aluminium or aluminium alloy article made of aluminium alloyed with at least one element selected from the group of elements that have non-white oxides, wherein the article is immersed in an electrolyte and subjected to a plasma anodising process, wherein the coating has a luminosity L*≥80% and comprises at least 50 wt % gamma alumina.

Viewed from a fifth aspect, there is provided a high luminosity inorganic coating on an article made of aluminium alloyed with at least one element selected from the group of elements that have non-white oxides, the inorganic coating being formed by way of a plasma anodising process, and wherein the coating has a surface luminosity L*≥80% and comprises at least 50 wt % gamma alumina, with non-white oxides and other compounds of the at least one element formed during the plasma anodising process being retained within a lattice structure of the gamma alumina coating so as not to impair the surface luminosity of the coating.

Viewed from a sixth aspect, there is provided an article made of aluminium alloyed with at least one element selected from the group of elements that have non-white oxides, coated with a high luminosity inorganic coating of the fifth aspect.

The at least one element may be a metal. In certain embodiments, the at least one element is a transition metal. Many transition metal oxides tend to be strongly coloured, and thus pose a problem when seeking to form a white coating with high luminosity. Alternatively or in addition, the at least one element may be another alloying element, for example a metalloid or an appropriate non-metal. Examples include silicon and/or carbon, among others.

The term "non-white" may, in some contexts, be understood to denote colours that would detract from or reduce the luminosity or "whiteness" of the finished coating if present on the surface of the coating, for example.

Preferably, the coating has a luminosity L*≥80.0%.

Embodiments of the present disclosure may overcome the limitations of known coating techniques by preventing the full crystallization of the coating at higher thicknesses. This may be achieved by lowering the anodic breakdown strength of the coating and thereby restricting the energy of plasma discharges.

In some embodiments, the coating comprises at least 60 wt % gamma-phase alumina, at least 70 wt % gamma-phase alumina, at least 80 wt % gamma-phase alumina or at least 90 wt % gamma-phase alumina.

In a preferred embodiment, the anodic breakdown strength of the coating in the electrolyte is kept below 300V. Preferably, the energy of the individual discharges is kept below 15 W. The resultant coating comprises primarily gamma phase alumina which has the ability to retain impurities such as transition metal impurities in its lattice, thus minimizing their tendency to create dark ceramic oxides that would darken the coating. This applies also to other impurities comprising oxides or other compounds of the at least one element with which the aluminium is alloyed.

In preferred embodiments, the finished coating has a thickness of at least 10 μm. In certain embodiments the finished coating has a thickness of at least 15 μm, at least 20 μm, at least 30 μm or even at least 40 μm. This is a particularly surprising result, since known white or ivory coatings are only possible at thicknesses of less than 10 μm due to the promotion of alpha crystallites and other coloured oxides as described above.

Embodiments of the present disclosure provide an inorganic coating having a high luminosity of at least 80.0% without the incorporation of additional salts of silicon, magnesium or tin or other materials, whether by electrophoresis or sol techniques. The high luminosity may be obtained as a result of the high gamma alumina content throughout the thickness of the coating, even in coatings thicker than 10 μm, without the need for the addition of other salts of high luminosity.

One possible technique for lowering the anodic breakdown strength of the coating is to increase the dissolved solids content of the electrolyte and increase the conductivity of the electrolyte.

Another technique is to promote a relatively open microstructure in the coating. This has the effect of allowing rapid cooling of the coating and restricting the growth of alpha-phase crystallites. In this case, micropores of diameter >1 μm, optionally >5 μm are helpful. Advantageously, the coating may have a porosity greater than 20%, optionally greater than 25%. It will be appreciated that there may also be some micropores of diameter <1 μm (or <5 μm), but it is currently believed that the presence of the larger diameter micropores is helpful for promoting cooling.

The anodic breakdown strength of the coating will generally increase as the thickness of the coating increases, but this will not generally be in a linear fashion. The anodic breakdown strength generally increases rapidly to a characteristic value at the start of the plasma anodising process, and then the rate of increase slows significantly.

Advantageously, the rate of increase of anodic breakdown strength can be slowed or halted by keeping the microstructure of the coating relatively open. This is in complete contrast to other known coating processes which promote the formation of coatings with a very dense microstructure and high breakdown strength.

The anodic breakdown strength of the coating can be measured at any given point during the coating process by reducing the applied voltage until no more discharging is observed. This can be monitored by visual observation, or by monitoring the current, for example the current or power of individual discharges. During discharge, there is an avalanche of current in the anodic part of the cycle and the "resistance" of the coating is much lower than with no discharge. A low breakdown strength is characterised by high current and visible discharges even at low voltage. Keeping the voltage low enables the power in individual discharges to be kept low, for example to 15 W or below.

Techniques for measuring the power of individual discharges are disclosed, for example, in the present Applicant's earlier-filed International patent application WO2015/008064, where a small test sample is connected in parallel to a main workpiece, and both are subjected simultaneously to a plasma anodising process.

In certain embodiments, it is advantageous to avoid too much deposition from the electrolyte into the coating. This is because embodiments of the present disclosure seek to grow aluminium oxide, and favouring conversion of the substrate into the coating is thus of benefit. This can be accomplished by tailoring the electrolyte formulation so as to avoid anions such as silicates and transition metals whose incorporation into the coating may be thermodynamically favourable.

The electrolyte may be a solution comprising up to 4 wt % ammonium phosphate, up to 2 wt % acetic acid, up to 2 wt % potassium hydroxide and up to 2 wt % sodium tetrafluoroborate. In one embodiment, the electrolyte is a solution comprising 2 wt % ammonium phosphate, 1 wt % acetic acid, 1 wt % potassium hydroxide and 1 wt % sodium tetrafluoroborate.

The electrolyte may be a solution comprising up to 6 wt % trisodium phosphate, up to 2 wt % ammonium hydroxide, up to 2 wt % citric acid and up to 1 wt % sodium fluoride. In another embodiment, the electrolyte is a solution comprising 3 wt % trisodium phosphate, 1 wt % ammonium hydroxide, 1 wt % citric acid 0.5 wt % sodium fluoride.

In some embodiments, the electrolyte has a pH in the range from 6 to 9, i.e. not strongly acid or alkaline. Such electrolytes may be both operator- and environmentally-friendly.

Other electrolyte formulations that achieve the properties of breakdown strength less than 300V and discharge power less than 15 W may also be used.

In certain embodiments, the length of each anodic discharge is less than 120 μs and/or the discharge energy is kept below 1.8 mJ.

Embodiments of the present disclosure provide coatings having a white inorganic finish that are UV stable, and are therefore highly suitable for external applications including architectural use and spacecraft/satellites.

BRIEF DESCRIPTION OF THE DRAWINGS

Embodiments of the invention are further described hereinafter with reference to the accompanying drawings, in which.

DETAILED DESCRIPTION

Example 1

An article of aluminium 6082 alloy was placed in an electrolyte bath containing a solution of 2 wt % ammonium phosphate, 1 wt % acetic acid, 1 wt % potassium hydroxide and 1 wt % sodium tetrafluoroborate. Anodic voltage pulses were applied with a voltage of 480V, the discharge power was maintained below 15 W, and the process was continued until the coating reached 40 μm thickness. At the end of the process, the anodic breakdown voltage of the coating in the bath was measured to be 290V.

Figure 1:
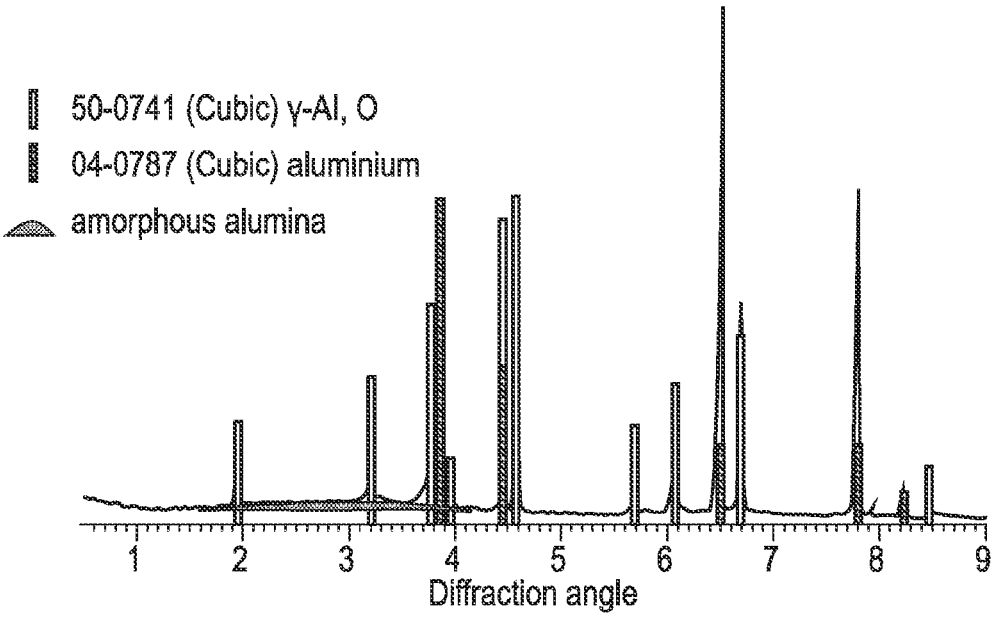
FIG. 1 is an X-ray diffraction spectrum for a first coating of an embodiment of the present disclosure.

X-ray diffraction was performed in Bragg-Brentano geometry, from 5-90° 2q, with 2 second, 0.02° steps in a 40 kV, 40 mA Phillips PW1830 Diffractometer. The resulting spectrum (FIG. 1) shows that the coating consists primarily of gamma phase alumina with a small amount of amorphous material. The coating had a white appearance and luminosity was measured on a Konica Minolta spectrometer using the CIE L*a*b* colour space to be 82.6%.

Figure 2:
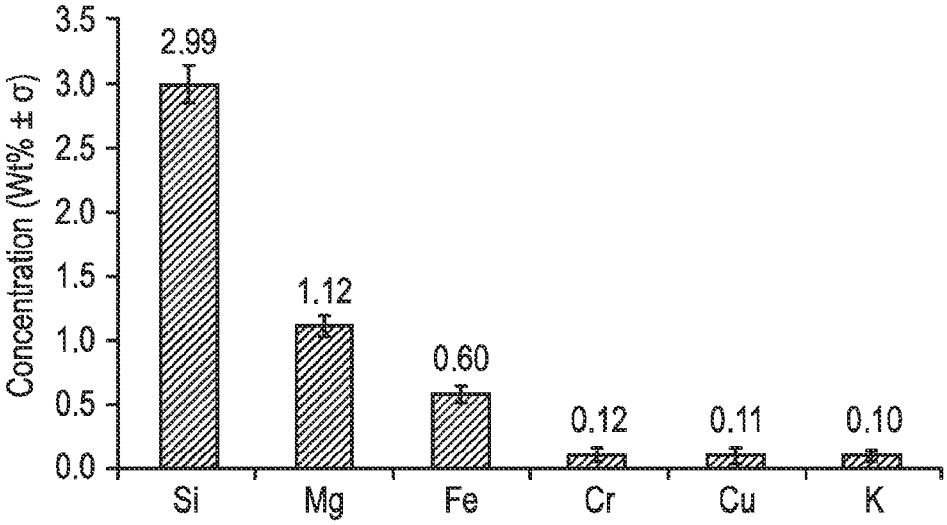
FIG. 2 is a graph showing the elemental composition of contaminants in the coating of the FIG. 1 embodiment.

The elemental composition of the finish was measured using electron dispersive spectroscopy (FIG. 2). The coating was found to comprise 95 wt % aluminium and oxygen with the remaining constituents being those found in the substrate alloy and in the approximate proportions of the substrate alloy. A typical spark anodised coating formed on 6082 would have a cream or brown appearance.

Example 2

An article of 2219 alloy, containing nominally 6 wt % Cu, was placed in a bath containing a solution of 3 wt % trisodium phosphate, 1 wt % ammonium hydroxide, 1 wt % citric acid and 0.5 wt % sodium fluoride and anodic pulses of 350V were applied, alternated with cathodic pulses of 100V. Discharge power was maintained below 15 W by adjusting the duration of the pulses. The process was continued until the coating thickness reached 15 μm. At the end of the process, the anodic breakdown voltage of the coating in the electrolyte was measured to be 195V. The resulting coating was X-rayed and found to comprise over 90 wt % gamma alumina. Typical plasma anodising of such an alloy would produce a dark grey to black coating due to the high amount of copper in the alloy. However, in this case, luminosity (L*) was measured at 82.2%.

Example 3

An article of 1050 alloy was placed in the same bath as Example 2 and bipolar pulses with 400V anodic voltage and 100V cathodic voltage were applied. Discharge power was maintained below 15 W by adjusting the duration of the pulses. The process was continued until the coating thickness reached 20 μm. At the end of the coating process, the anodic breakdown voltage of the coating was measured to be 192V. Luminosity (L*) was measured at 87.1%.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A white inorganic coating on an article made of aluminum alloyed with at least one element selected from the group of elements that have non-white oxides, the coating being formed by way of a plasma electrolytic oxidation process in an electrolyte, and wherein the coating has a surface lightness L*≥80, includes micropores of diameter >1 μm, has a porosity of at least 20%, and an anodic breakdown voltage of less than 300V, and comprises at least 50 wt % gamma alumina, with non-white oxides and other compounds of the at least one element formed during the plasma electrolytic oxidation process being retained within a lattice structure of the gamma alumina so as not to impair the surface lightness of the coating.

2. The coating as claimed in claim 1, wherein the at least one element comprises a metal.

3. The coating as claimed in claim 1, wherein the at least one element comprises a transition metal.

4. The coating as claimed in claim 1, wherein the at least one element comprises a metalloid and/or a non-metal.

5. The coating as claimed in claim 1, wherein the coating has a porosity of at least 25%.

6. The coating as claimed in claim 1, wherein the coating has a thickness of at least 10 μm.

7. The coating as claimed in claim 1, wherein the coating has a thickness of at least 15 μm.

8. The coating as claimed in claim 1, wherein the coating has a surface lightness L*>80.

9. An article made of aluminum alloyed with at least one element selected from the group of elements that have non-white oxides, coated with a white inorganic coating as claimed in claim 1.

* * * * *